US010137554B2

(12) United States Patent
Hsu et al.

(10) Patent No.: US 10,137,554 B2
(45) Date of Patent: Nov. 27, 2018

(54) HAND-HELD BELT SANDER

(71) Applicant: Techway Industrial Co., Ltd., Taichung (TW)

(72) Inventors: Chih-Hua Hsu, Taichung (TW); Shao-Lung Chiu, Taichung (TW); Cheng-Yuan Lin, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 214 days.

(21) Appl. No.: 15/244,027

(22) Filed: Aug. 23, 2016

(65) Prior Publication Data

US 2018/0056474 A1 Mar. 1, 2018

(51) Int. Cl.
*B24B 23/06* (2006.01)
*B24B 23/00* (2006.01)

(52) U.S. Cl.
CPC ..... *B24B 23/06* (2013.01); *B24B 23/005* (2013.01)

(58) Field of Classification Search
CPC ..... B24B 23/06; B25G 1/066
USPC ..... 451/355, 296; 81/177.7, 177.8
See application file for complete search history.

(56) References Cited

U.S. PATENT DOCUMENTS 3,643,385 A * 2/1972 Mikiya ..... B24B 23/06 451/355
D338,382 S * 8/1993 Fukuda ..... D8/62
D508,189 S * 8/2005 Murakami ..... D8/62
9,156,120 B2 * 10/2015 Kosonen ..... B24B 21/20

FOREIGN PATENT DOCUMENTS

CN 102699798 A * 10/2012
TW M422448 U1 2/2012

OTHER PUBLICATIONS

Machine Translation of App. No. CN 102699798 A.*
TW search report in corresponding TW application No. 105112751 dated Mar. 30, 2017 (2 pages).

* cited by examiner

*Primary Examiner* — Monica Carter
*Assistant Examiner* — Lauren Beronja
(74) *Attorney, Agent, or Firm* — Trop Pruner & Hu, P.C.

(57) ABSTRACT

A hand-held belt sander includes a head, an arm, a retaining unit, and a positioning unit. The head includes a mounting seat surrounding an axis. The arm has a sleeve segment mounted to the mounting seat. The retaining unit has an annular groove formed in the mounting seat, and multiple protrusions disposed on the sleeve segment and engaging the annular groove. The positioning unit includes multiple engaging grooves formed in the mounting seat, and an engaging member disposed on the sleeve segment. When the engaging member engages one of the engaging grooves, the arm is positioned relative to the head at an operating position. When the engaging member is disengaged from the one of the engaging grooves, the arm is rotatable about the axis relative to the head.

8 Claims, 7 Drawing Sheets

HAND-HELD BELT SANDER

FIELD

The disclosure relates to a belt sander, and more particularly to a hand-held belt sander with enhanced safety.

BACKGROUND

A conventional hand-held belt sander has a body segment, a sanding belt segment mounted to the body segment and rotatable about an axis relative to the body segment, and a positioning device configured in a way such that the sanding belt segment can be positioned relative to the body segment at a desired operating angle, so that sanding operation can be performed easily and conveniently in a relatively narrow working space, such as a groove or a bore.

In order to prevent undesired changes of the operating angle during the sanding operation, the positioning device typically includes a screw bolt that is screwed tightly into the sanding belt segment and the body segment of the conventional hand-held belt sander so as to prevent rotational movement of the sanding belt segment relative to the body segment, such as that disclosed in FIG. 1 of Japanese Patent No. 4017348, or in FIG. 1 of Japanese Patent No. 4154393.

However, the screw bolt of the positioning device may be loosed due to vibration of the conventional hand-held belt sander during the sanding operation, thereby creating safety concerns. Furthermore, the sanding belt segment may be separated from the body segment along the axis due to the vibration.

SUMMARY

Therefore, an object of the disclosure is to provide a hand-held belt sander that can alleviate at least one of the drawbacks of the prior art.

According to the disclosure, the hand-held belt sander includes a casing, an arm, a sanding unit, a retaining unit, and a positioning unit.

The casing includes a head and a handgrip that is connected to the head. The head includes a mounting seat that surrounds an axis and that has an open end.

The arm has a sleeve segment and an arm body. The sleeve segment is mounted to the mounting seat and is rotatable about the axis. The arm body extends from the sleeve segment and is transverse to the axis.

The sanding unit includes a drive member, a driving roller, a driven roller, and a sanding belt. The drive member is disposed in the head. The driving roller is driven rotatably by the drive member and protrudes from the open end of the mounting seat. The driven roller is rotatably disposed at a distal end of the arm body of the arm. The sanding belt is trained on the driving roller and the driven roller.

The retaining unit has an annular groove and a plurality of protrusions. The annular groove is formed in the mounting seat, and opens away from the axis. The protrusions are disposed on the sleeve segment of the arm, and engage the annular groove so as to prevent separation of the arm from the head along the axis.

The positioning unit includes a plurality of spaced-apart engaging grooves and an engaging member. The engaging grooves are arranged along an imaginary circle which surrounds the axis, and are formed in one of the mounting seat and the sleeve segment. The engaging member is disposed on the other one of the mounting seat and the sleeve segment, and is operable to removably engage one of the engaging grooves.

When the engaging member engages the one of the engaging grooves, the arm is positioned relative to the head at an operating position.

When the engaging member is disengaged from the one of the engaging grooves, the arm is rotatable about the axis relative to the head.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
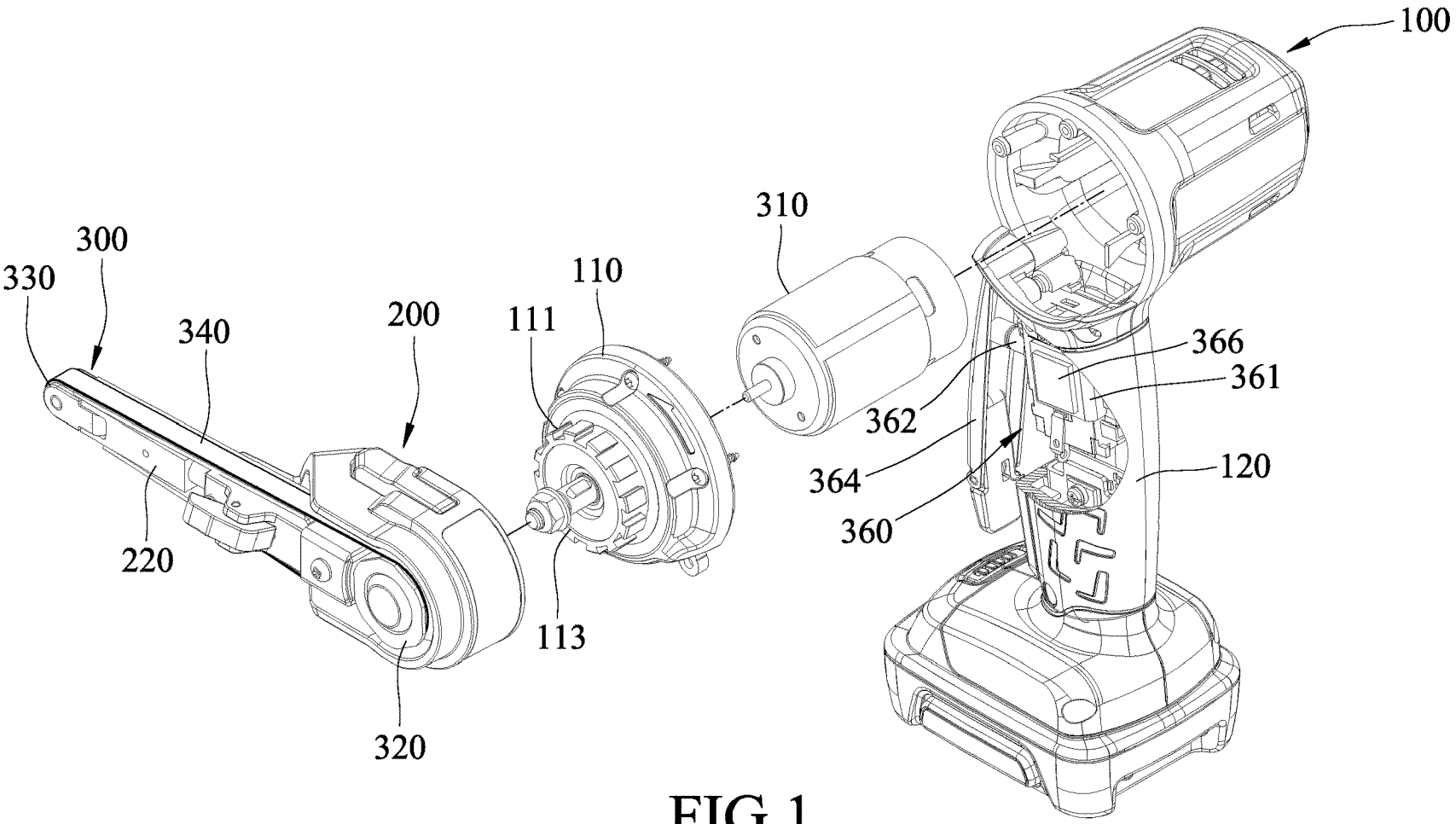
FIG. 1 is a partly exploded perspective view illustrating an embodiment of a hand-held belt sander according to the disclosure, in which a handgrip of a casing of the hand-held belt sander is fragmented.

Referring to FIGS. 1 to 4, an embodiment of a hand-held belt sander according to the disclosure includes a casing 100, an arm 200, a sanding unit 300, a retaining unit 400, and a positioning unit 500.

The casing 100 includes a head 110 and a handgrip 120 that is connected to the head 110. The head 110 includes a mounting seat 111 that surrounds an axis (L), and that has an open end 113, and a passage groove 114 extending parallel to the axis (L).

The arm 200 has a sleeve segment 211 (see FIG. 3) and an arm body 220. The sleeve segment 211 is mounted to the mounting seat 111, is rotatable about the axis (L), and is formed with a through hole 212.

The arm body 220 extends from the sleeve segment 211 and is transverse to the axis (L).

Figure 2:
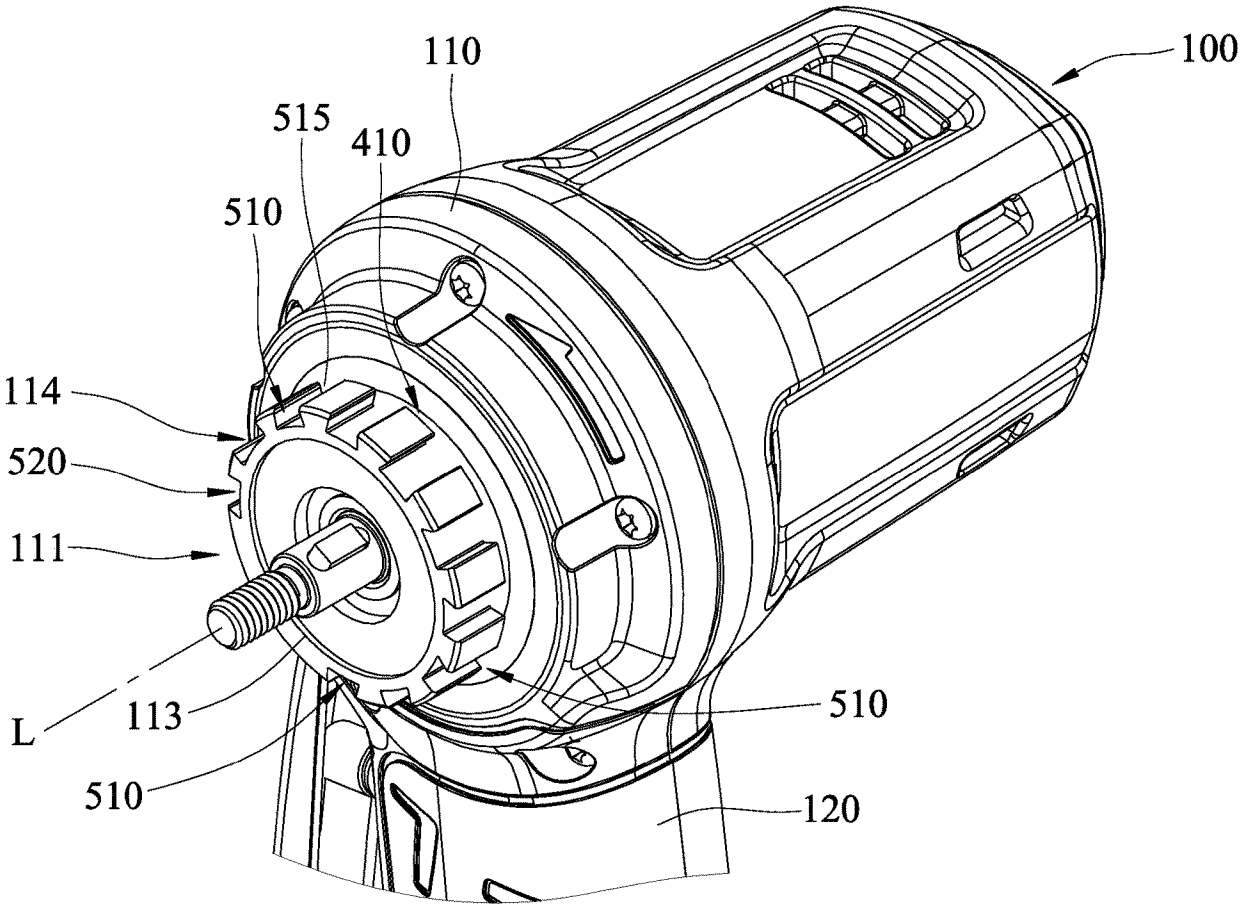
FIG. 2 is a fragmentary perspective view of the embodiment, illustrating a head of the casing.
Figure 7:
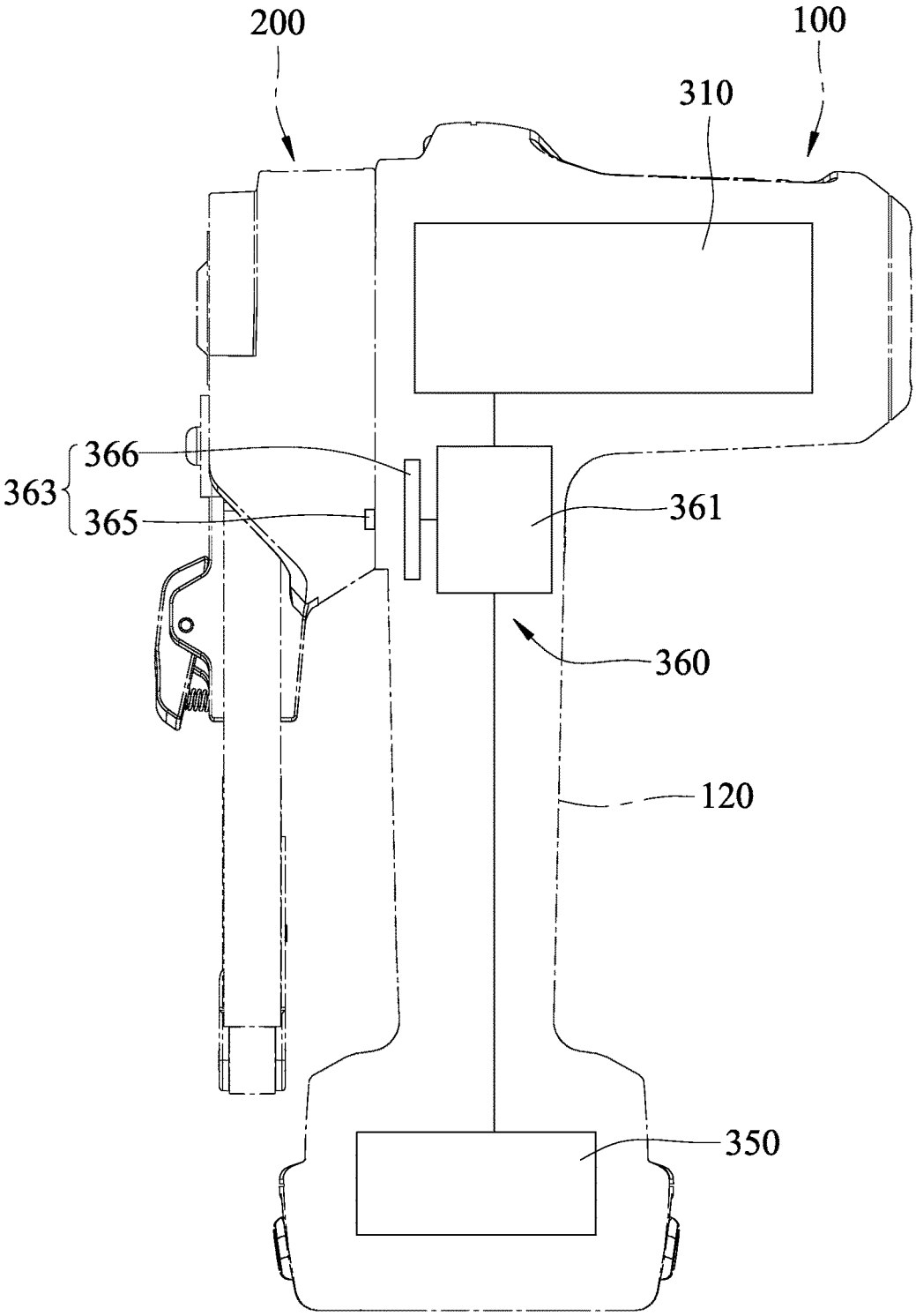
FIG. 7 is a schematic view of the embodiment, illustrating positions of an actuator and a sensor of a switch circuit of the hand-held belt sander when the arm is at the collapsed position.

Referring to FIGS. 1, 2, and 7, the sanding unit 300 includes a drive member 310, a driving roller 320, a driven roller 330, a sanding belt 340, a battery 350, and a switch circuit 360.

The drive member 310 is disposed in the head 110. The driving roller 320 is driven rotatably by the drive member 310 and protrudes from the open end 113 of the mounting seat 111. The driven roller 330 is rotatably disposed at a distal end of the arm body 220 of the arm 200. The sanding belt 340 is trained on the driving roller 320 and the driven roller 330. The battery 350 is disposed in the handgrip 120. The switch circuit 360 is electrically connected to the battery 350 and the drive member 310, and includes a controller 361, and a contact switch 362 and a safety switch 363 (see FIG. 7) that are electrically connected to the controller 361. The contact switch 362 includes a press member 364 that is disposed in the handgrip 120 and that is adapted to be pressed by an operator. As shown in FIG. 7, the safety switch 363 includes an actuator 365 that is disposed in the arm 200, and a sensor 366 that is disposed in the handgrip 120. In this embodiment, the drive member 310 is a motor. The sensor 366 is, but not limited to be, a Hall sensor 366. The actuator 365 is, but not limited to be, a magnet. In certain embodiments, the safety switch 363 may be a reed switch or a limited switch, etc.

Figure 3:
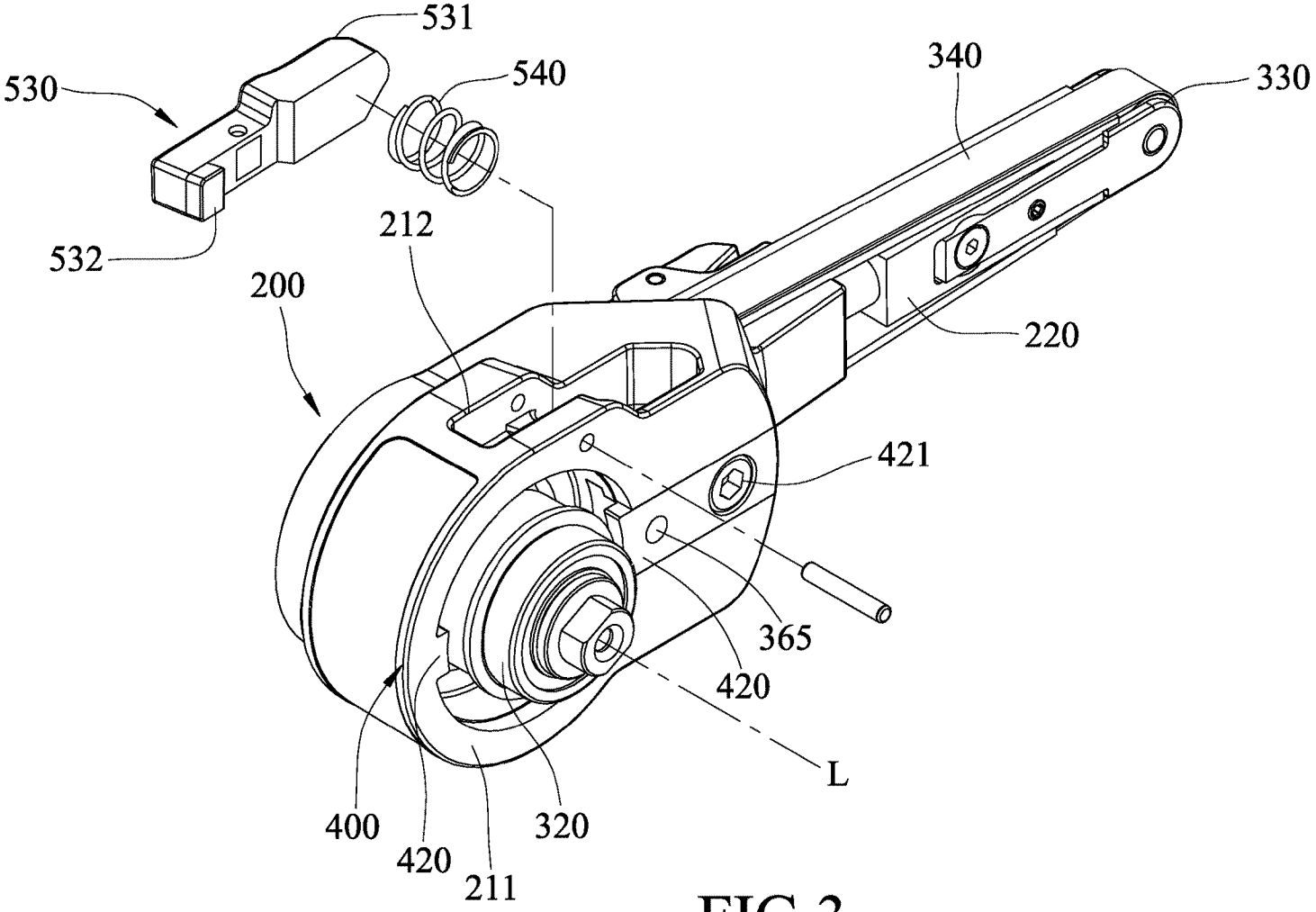
FIG. 3 is a partly exploded perspective view of an engaging member of a positioning unit and an arm of the embodiment.
Figure 5:
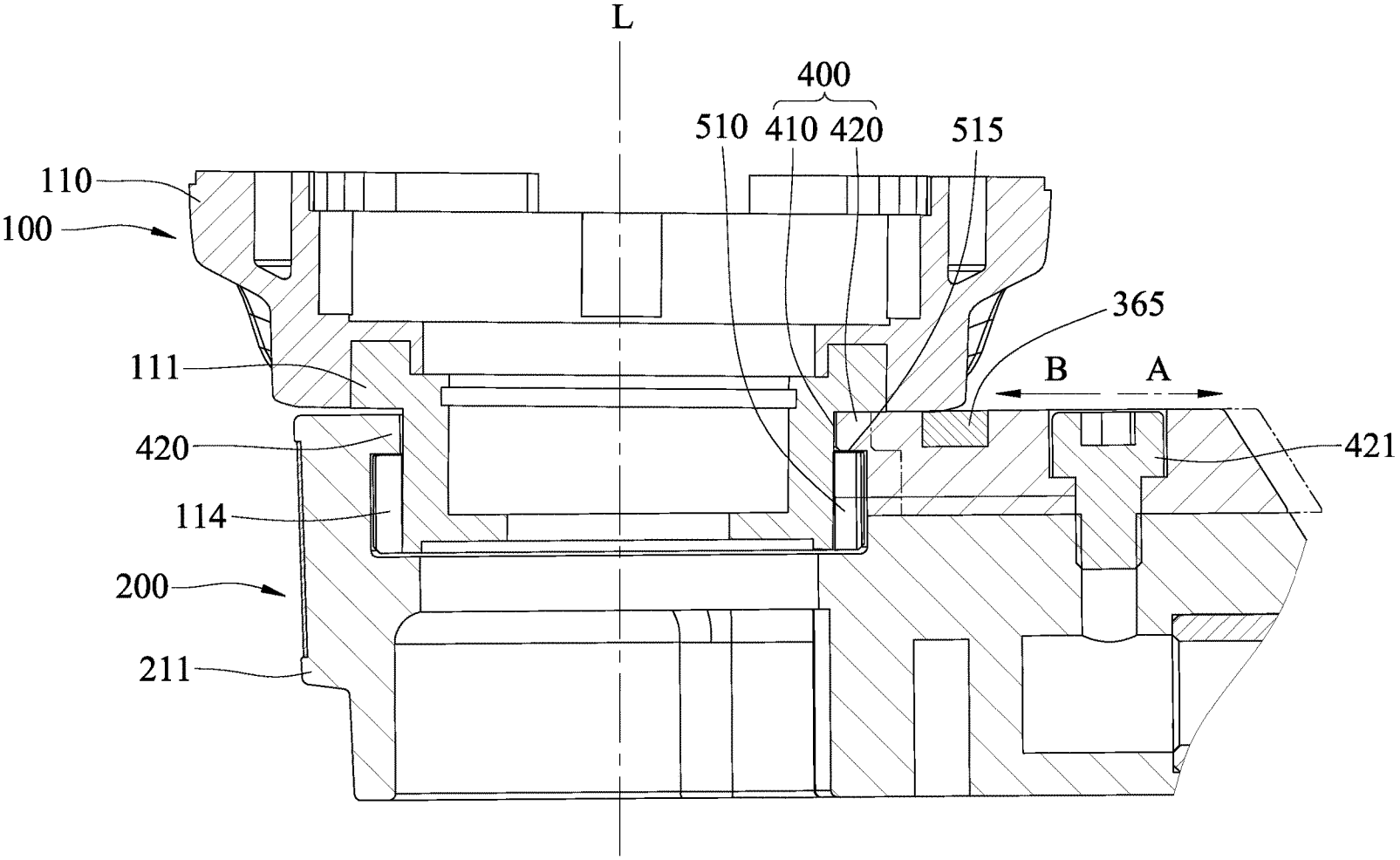
FIG. 5 is a fragmentary sectional view of the embodiment, illustrating two protrusions of a retaining unit of the hand-held belt sander engaging an annular groove of the retaining unit.

Referring to FIGS. 2, 3, and 5, the retaining unit 400 has an annular groove 410 and two protrusions 420. The annular groove 410 is formed in the mounting seat 111, opens away from the axis (L), and is in spatial communication with the passage groove 114. The protrusions 420 are disposed on the sleeve segment 211 of the arm 200, are spaced apart from each other by 180 degrees, and engage the annular groove 410 so as to prevent separation of the arm 200 from the head 110 along the axis (L). In this embodiment, one of the protrusions 420 is fixedly disposed on the sleeve segment 211. The other one of the protrusions 420 is movably disposed on the sleeve segment 211 and on which the actuator 365 is disposed.

Figure 4:
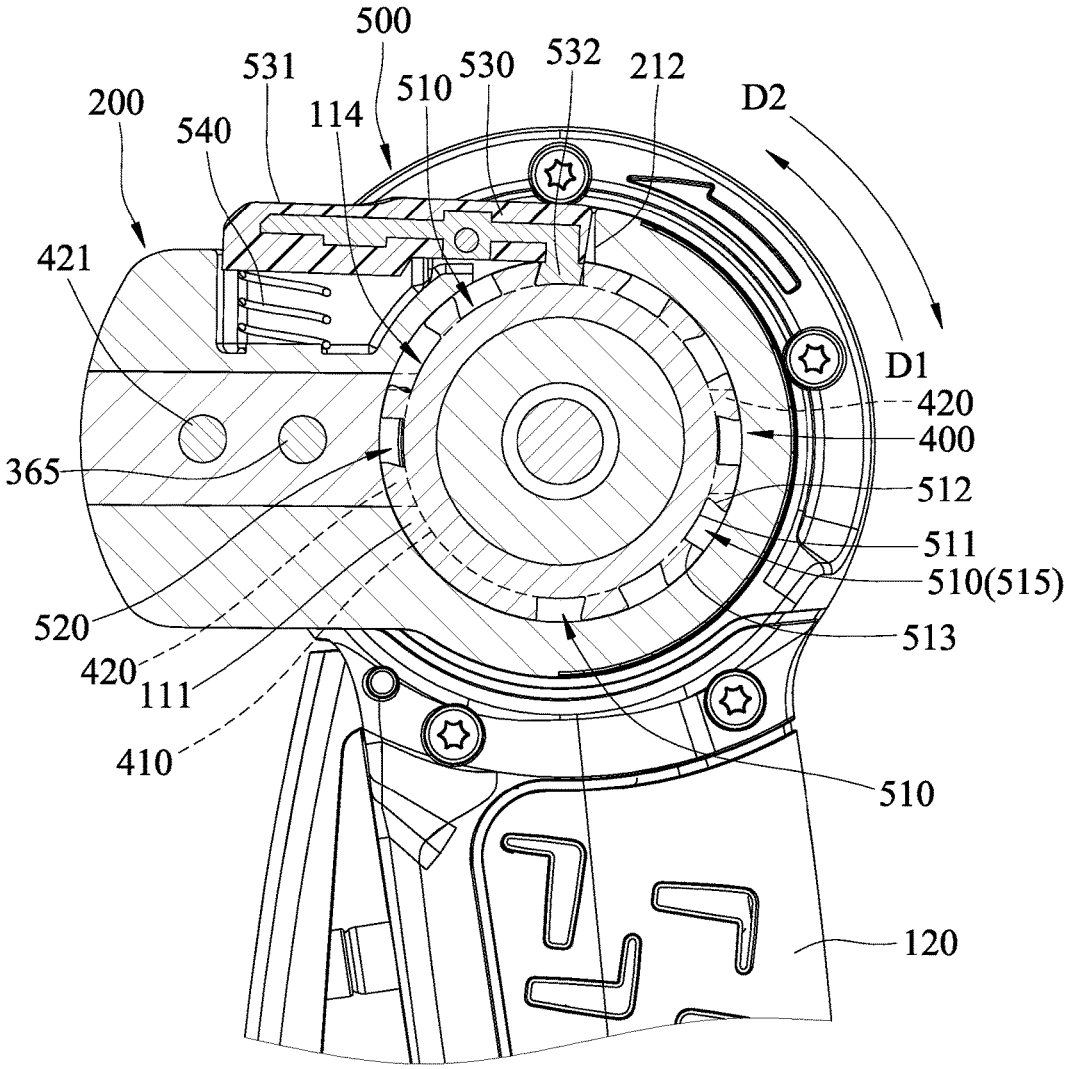
FIG. 4 is a fragmentary sectional view of the embodiment, illustrating the engaging member engaging one of a plurality of engaging grooves of the positioning unit so that the arm is at an operating position.

Referring to FIGS. 4 and 5, when mounting the sleeve segment 211 of the arm 200 on the mounting seat 111 of the head 110, the other one of the protrusions 420 is moved away from the one of the protrusions 420, as indicated by the imaginary arrow (A) in FIG. 5, until the one of the protrusions 420 is aligned with and slides through the passage groove 114 and into the annular groove 410. Subsequently, the other one of the protrusions 420 is then moved toward the one of the protrusions 420 to engage the annular groove 410, as indicated by the solid arrow (B) in FIG. 5, and is locked to the sleeve segment 211 of the arm 200 via a screw bolt 421. In this way, the protrusions 420 rotatably engage the annular groove 410, and separation of the arm 200 from the head 110 along the axis (L) is prevented.

Referring to FIGS. 2 to 4, the positioning unit 500 includes a plurality of spaced-apart engaging grooves 510, a receiving groove 520, an engaging member 530, and a resilient member 540.

In this embodiment, the engaging grooves 510 are formed in the mounting seat 111, and are arranged along an imaginary circle which surrounds the axis (L). Each of the engaging grooves 510 is defined by opposite first and second abutment surfaces 512, 513, and a bottom surface 511 that interconnects the first and second abutment surfaces 512, 513. Each of the engaging grooves 510 is configured in a way such that each of the protrusions 420 is securely retained in the annular groove 410 so as to prevent each of the protrusions 420 from being disengaged from the annular groove 410 via the engaging grooves 510. More specifically, each of the engaging grooves 510 has an open end 515 communicating spatially with and opening toward the annular groove 410. Each of the protrusions 420 has a cross section larger than the open end 515 of each of the engaging grooves 510 such that each of the protrusions 420 is not allowed to enter any one of the engaging grooves 510 via the open end 515.

The receiving groove 520 is formed in the mounting seat 111 at a side of the engaging grooves 510, and is disposed on the imaginary circle.

The engaging member 530 is disposed on the sleeve segment 211, and is operable to removably engage one of the engaging grooves 510. More specifically, the engaging member 530 is pivotably mounted to the sleeve segment 211, and has an engaging tooth 532 disposed in the through hole 212, and a knob 531 extending out of the through hole 212.

It should be noted that in certain embodiments, the engaging grooves 510 may be formed in the sleeve segment 211, and the engaging member 530 may be disposed on the mounting seat 111. However, a relatively complicated design may be required for the knob 531 of the engaging member 530 to be easily accessible by the operator.

The resilient member 540 is disposed for biasing the engaging member 530 toward the engaging grooves 510.

When the knob 531 of the engaging member 530 is pressed and the engaging tooth 532 does not engage any one of the engaging grooves 510 against a resilient force of the resilient member 540, the arm 200 is rotatable about the axis (L) relative to the head 110 in a first rotational direction (D1) and in a second rotational direction (D2) (see FIG. 4) opposite to the first rotational direction (D1).

When the arm 200 is rotated to a desired position relative to the head 110, the knob 531 of the engaging member 530 can be released, so that the resilient member 540 biases the engaging member 530 to rotate in the second rotational direction (D2) so as to engage the engaging tooth 532 with one of the engaging grooves 510. At this time, the arm 200 is positioned relative to the head 110 at an operating position, where the engaging tooth 532 of the engaging member 530 abuts against the first abutment surface 512 so as to prevent rotation of the arm 200 in the first rotational direction (D1), and abuts against the second abutment surface 513 so as to prevent rotation of the arm 200 in the second rotational direction (D2). After the arm 200 is positioned at the operating position, the press member 364 of the contact switch 362 can be pressed to output an operating signal to the controller 361 to actuate the drive member 310 to drive rotation of the driving roller 320.

It is worth mentioning that an angle between the first abutment surface 512 and the bottom surface 511 of each of the engaging grooves 510 ranges from 60 degrees to 85 degrees. In this embodiment, the angle is 75 degrees. As such, when the knob 531 of the engaging member 530 is not pressed but the arm 200 is moved in the first rotational direction (D1) by accident, possibility of the engaging tooth 532 of the engaging member 530 being disengaged from the one of the engaging grooves 510 is effectively reduced.

Figure 6:
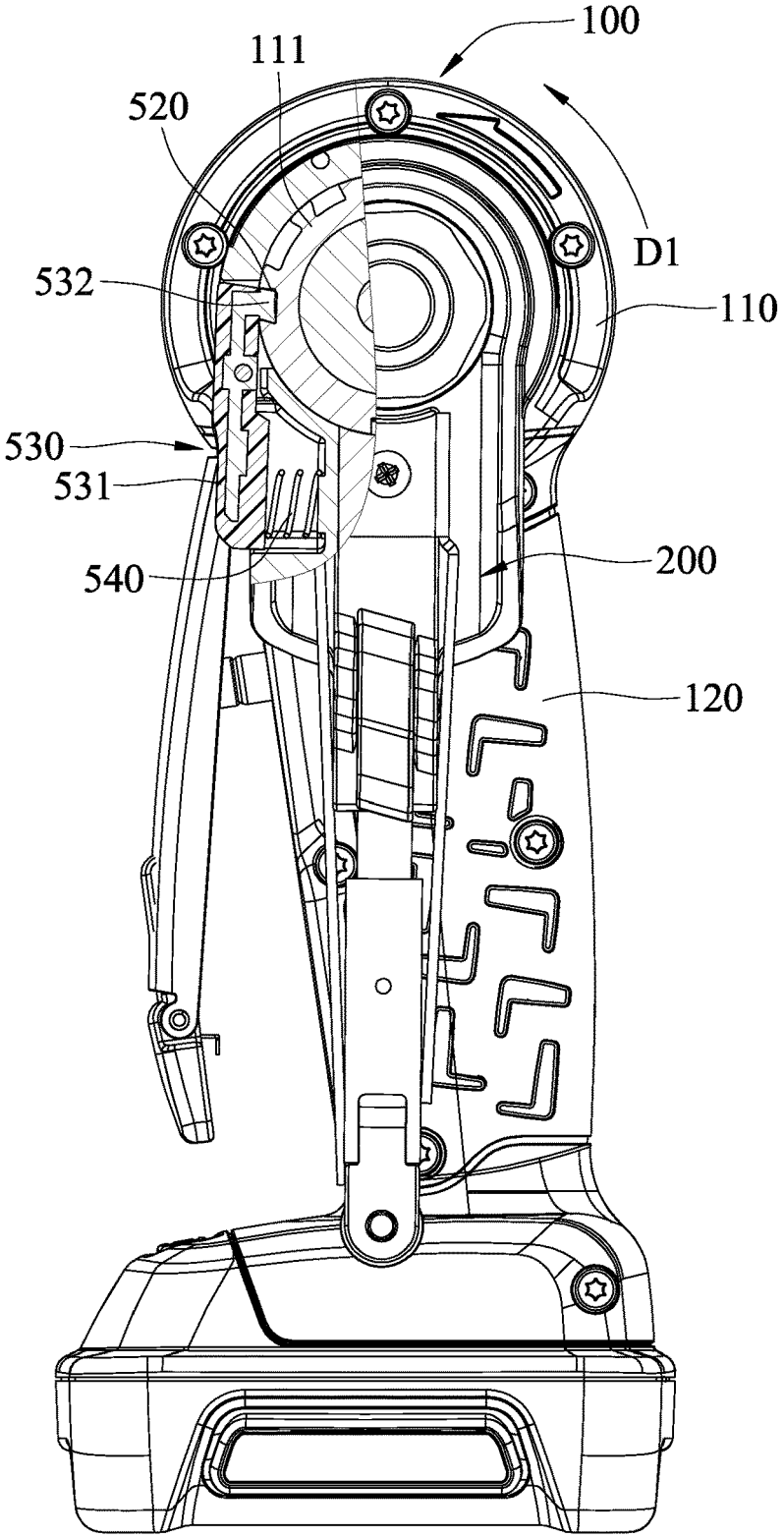
FIG. 6 is a partly sectional side view of the embodiment, illustrating the engaging member engaging a receiving groove of the positioning unit so that the arm is at a collapsed position.

Furthermore, referring to FIG. 6, the engaging member 330 is operable to removably engage the receiving groove 520 so as to position the arm 200 relative to the head 110 at a collapsed position, where the arm 200 extends substantially parallel to the handgrip 120 for convenience in storage.

As shown in FIG. 7, when the arm 200 is at the collapsed position and the actuator 365 is proximate to and sensed by the sensor 366, the switch circuit 360 generates a control signal, and the controller 361 cuts off power supplied by the battery 350 to the drive member 310 in response to the control signal, which results in failure of the operating signal. In this way, actuation of the drive member 310 when the press member 364 is accidentally pressed is effectively prevented.

In summary, the hand-held belt sander of the disclosure has the following advantages:

1. Since the protrusions 420 rotatably engage the annular groove 410 and are securely retained in the annular groove 410, separation of the arm 200 from the head 110 along the axis (L) is effectively prevented when the arm 200 rotates in the first rotational direction (D1) or in the second rotational direction (D2).

2. The engaging grooves 510 and the engaging tooth 532 are configured to have an enhanced coupling strength, thereby effectively reducing the possibility of separation between the engaging tooth 532 and the one of the engaging grooves 510 due to vibration of the hand-held belt sander when the arm 200 is at the operating position. Moreover, when it is desired to change the position of the arm 200 relative to the head 110, disengagement of the engaging tooth 532 from the one of the engaging grooves 510 can be performed in a relatively fast and convenient manner compared with adjustment using the screw bolt in the above-mentioned prior art.

3. The angle formed between the first abutment surface 512 and the bottom surface 511 of each of the engaging grooves 510 is an acute angle, thereby reducing the possibility of separation of the engaging tooth 532 from the one of the engaging grooves 510.

4. When the arm 200 is at the collapsed position, the controller 361 cuts off the power supplied by the battery 350 to the drive member 310 so as to prevent actuation of the drive member 310 when the press member 364 is accidentally pressed, thereby increasing safety when the hand-held belt sander is stored.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A hand-held belt sander comprising:

a casing including a head and a handgrip that is connected to said head, said head including a mounting seat that surrounds an axis and that has an open end;

an arm having a sleeve segment that is mounted to said mounting seat and that is rotatable about the axis, and an arm body that extends from said sleeve segment and that is transverse to the axis;

a sanding unit including a drive member that is disposed in said head, a driving roller that is driven rotatably by said drive member and that protrudes from said open end of said mounting seat, a driven roller that is rotatably disposed at a distal end of said arm body of said arm, and a sanding belt that is trained on said driving roller and said driven roller;

a retaining unit having an annular groove that is formed in said mounting seat, and that opens away from the axis, and a plurality of protrusions that are disposed on said sleeve segment of said arm, and that engage said annular groove so as to prevent separation of said arm from said head along the axis; and a positioning unit including a plurality of spaced-apart engaging grooves that are arranged along an imaginary circle which surrounds the axis and that are formed in one of said mounting seat and said sleeve segment, and an engaging member that is disposed on the other one of said mounting seat and said sleeve segment, and that is operable to removably engage one of said engaging grooves;

wherein, when said engaging member engages the one of said engaging grooves, said arm is positioned relative to said head at an operating position;

wherein, when said engaging member is disengaged from the one of said engaging grooves, said arm is rotatable about the axis relative to said head;

wherein said positioning unit further includes a receiving groove that is formed at a side of said engaging grooves and that is disposed on the imaginary circle, said engaging member being operable to removably engage said receiving groove so as to position said arm relative to said head at a collapsed position, where said arm extends substantially parallel to said handgrip;

wherein said drive member is a motor;

wherein said sanding unit further includes a battery that is disposed in said handgrip, and a switch circuit that is electrically connected to said battery and said drive member, and that includes a controller and a safety switch, said safety switch including an actuator that is disposed in said arm, and a sensor that is disposed in said handgrip; and wherein, when said arm is at the collapsed position and said actuator is sensed by said sensor, said switch circuit generates a control signal, and said controller cuts off power supplied by said battery to said drive member in response to said control signal.

2. The hand-held belt sander as claimed in claim 1, wherein:

said engaging grooves are formed in said mounting seat;

said sleeve segment is formed with a through hole;

said engaging member has an engaging tooth disposed in said through hole, and a knob extending out of said through hole and operable to engage said engaging tooth with the one of said engaging grooves to position said arm at the operating position, or to disengage said engaging tooth from the one of said engaging grooves so as to permit rotation of said arm about the axis relative to said head; and said positioning unit further includes a resilient member for biasing said engaging tooth toward said engaging grooves.

3. The hand-held belt sander as claimed in claim 2, wherein:

when said engaging member is disengaged from the one of said engaging grooves against a resilient force of said resilient member, said arm is rotatable about the axis relative to said head in a first rotational direction and in a second rotational direction opposite to the first rotational direction;

each of said engaging grooves is defined by opposite first and second abutment surfaces, and a bottom surface that interconnects said first and second abutment surfaces;

when said engaging member engages the one of said engaging grooves, said engaging tooth of said engaging member abuts against said first abutment surface so as to prevent rotation of said arm in the first rotational direction, and abuts against said second abutment surface so as to prevent rotation of said arm in the second rotational direction;

said engaging member is pivotably mounted to said sleeve segment; and said resilient member is disposed for biasing said engaging member to rotate in the second rotational direction.

4. The hand-held belt sander as claimed in claim 3, wherein an angle between said first abutment surface and said bottom surface of each of said engaging grooves ranges from 60 degrees to 85 degrees.

5. The hand-held belt sander as claimed in claim 2, wherein each of said engaging grooves is configured in a way such that each of said protrusions is securely retained in said annular groove so as to prevent each of said protrusions from being disengaged from said annular groove via said engaging grooves.

6. The hand-held belt sander as claimed in claim 5, wherein:

each of said engaging grooves has an open end communicating spatially with and opening toward said annular groove; and each of said protrusions has a cross section larger than said open end of each of said engaging grooves such that each of said protrusions is not allowed to enter any one of said engaging grooves via said open end.

7. The hand-held belt sander as claimed in claim 6, wherein said retaining unit includes two of said protrusions that are spaced apart from each other by 180 degrees, one of said protrusions being fixedly disposed on said sleeve segment, the other one of said protrusions being movably disposed on said sleeve segment.

8. The hand-held belt sander as claimed in claim 7, wherein:

said mounting seat further has a passage groove that extends parallel to the axis and that is in spatial communication with said annular groove; and when mounting said sleeve segment on said mounting seat, said other one of said protrusions is moved away from said one of said protrusions until said one of said protrusions slides through said passage groove into said annular groove, and is then moved toward said one of said protrusions to engage said annular groove.

* * * * *